United States Patent [19]

Brown

[11] 4,370,105

[45] Jan. 25, 1983

[54] AUTOMATIC PUMP FOR DEEP WELLS

[76] Inventor: Kenard D. Brown, 3451 Terrace Knoll Ct., Reno, Nev. 89512

[21] Appl. No.: 240,164

[22] Filed: Mar. 3, 1981

Related U.S. Application Data

[60] Division of Ser. No. 951,785, Oct. 16, 1978, which is a continuation-in-part of Ser. No. 651,512, Jan. 22, 1976, Pat. No. 4,120,612.

[51] Int. Cl.[3] ..... F04B 35/02; F04B 17/00

[52] U.S. Cl. ..... 417/360; 417/390

[58] Field of Search ..... 417/360, 390; 166/187, 166/106, 179, 122, 177, 301; 277/34.6

[56] References Cited

U.S. PATENT DOCUMENTS

| | | | |
|---|---|---|---|
| 2,730,176 | 1/1956 | Herbold | 166/177 |
| 2,781,854 | 2/1957 | Boer et al. | 166/187 |
| 2,966,946 | 1/1961 | McCulloch et al. | 166/187 X |
| 3,918,520 | 11/1975 | Hutchison | 166/187 X |

*Primary Examiner*—William L. Freeh

*Attorney, Agent, or Firm*—Wm. Griffith Edwards

[57] ABSTRACT

An automatic pump for deep wells comprises a long stroke reciprocating pump having its piston normally in its bottom position and an automatic control dependent upon the collection of a predetermined amount of liquid in the pump cylinder above the piston for actuating the piston to pump the liquid into a production line. The automatic control includes an electric motor driven hydraulic pump and a reservoir of hydraulic fluid which is actuated upon filling of the reciprocating pump chamber to supply hydraulic fluid to a closed chamber below the piston and force the piston upwardly to discharge liquid from the pump cylinder. Gas collected in the top of the pump cylinder results in low starting current and a saving of energy. The hydraulic pump is reversed automatically upon completion of the pumping stroke of the piston. The assembly may be inserted in a well casing on a wire line and positioned in the casing, a packer being provided between the assembly and the casing. When the assembly is to be removed, if the packer has become bonded to the casing, release may be facilitated by use of ultrasonic energy.

10 Claims, 5 Drawing Figures

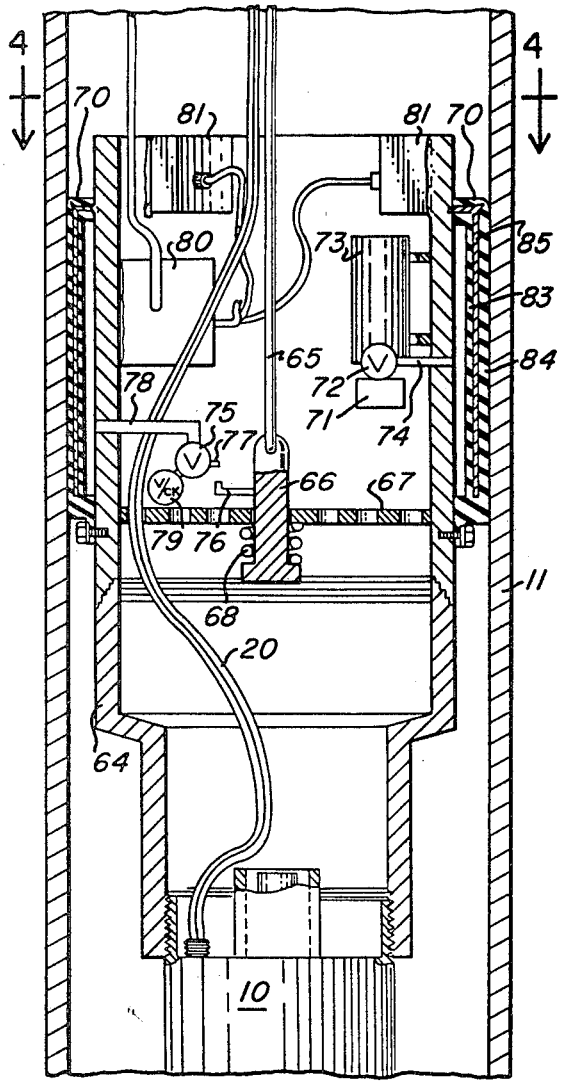
Fig.-3
Fig.-4
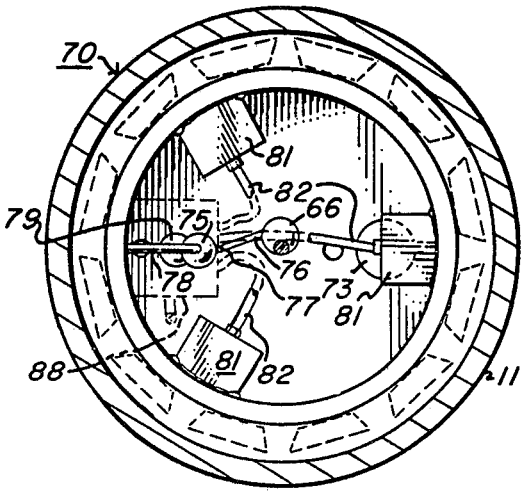
Fig.-5
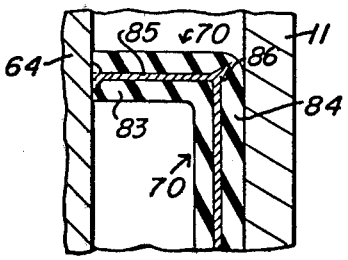

AUTOMATIC PUMP FOR DEEP WELLS

This application is a division of my copending application Ser. No. 951,785 filed Oct. 16, 1978 which is a continuation-in-part of application Ser. No. 651,512 filed Jan. 22, 1976 now U.S. Pat. No. 4,120,612 issued Oct. 17, 1978.

This invention relates to an improved down hole pump for oil wells and the like and particularly to a deep well pump for oil field use which is automatic in operation and pumps at a rate determined by the rate of flow of the liquid of the well in which it is installed.

The present invention is an improvement on the invention of my U.S. Pat. No. 3,225,697 issued Dec. 28, 1965.

The deep well pump disclosed in my above patent has provided a system whereby liquids are pumped from the well only after a predetermined volume of liquid has entered the pump cylinder from the formation in which the well is located. Thus power is used only when the predetermined volume of liquid has been accumulated; this represents a substantial saving of energy over that expended for continuous low volume production pump operation.

It is an object of my invention to provide a deep well pump of the automatic type including an improved arrangement for inserting and positioning the pump within a well casing.

It is another object of my invention to provide an automatic deep well pump assembly including an improved arrangement utilizing an electric motor in the pump assembly for actuating the pump and an improved arrangement for suspending the assembly on a wire line for insertion, lowering and positioning the assembly in a well casing.

SUMMARY OF THE INVENTION

Briefly, in carrying out the objects of my invention in one embodiment thereof, I provide a long stroke reciprocating pump and a hydraulic reservoir and a driving assembly including a hydraulic pump and an electric motor for driving the hydraulic pump; the hydraulic pump delivers fluid from the reservoir which is mounted in the assembly above the long stroke pump. The fluid is delivered to a closed chamber below the piston of the reciprocating pump; when energized, the electric motor drives the hydraulic pump to deliver hydraulic fluid to the closed chamber and drives the piston upwardly thereby delivering the liquid from the cylinder to a production line. Check valves at the discharge end of the pump cylinder prevent reverse flow of the liquid. The upward movement of the reciprocating piston is limited by a switch which reverses the hydraulic pump at a predetermined point, thus reversing the piston and returning the hydraulic fluid to the reservoir. The upper portion of the reservoir may contain a quantity of nitrogen or other neutral gas, which provides a surge chamber action, the return of the fluid compressing the gas to the extent necessary. The pump assembly is arranged to be inserted in a well casing on a wire line and to be positioned and seated in place on a packer. The packer is released for removing the assembly. If the packer has become bonded to the casing, ultrasonic vibration may be employed to release the bond.

The features of novelty which characterize this invention are pointed out with particularity in the claims annexed to and forming a part of this Specification. The invention itself, however, both as to its construction and manner of use, together with further objects and advantages thereof, will best be understood upon reference to the following description taken in connection with the accompanying drawings in which:

BRIEF DESCRIPTION OF THE DRAWINGS

FIG. 3 is an enlarged sectional elevational view illustrating diagrammatically a modified arrangement of the installing device for the pump;

FIG. 4 is a sectional view taken along the line 4—4 of FIG. 3; and

FIG. 5 is an enlarged sectional view of a detail of the structure shown in FIG. 3.

DESCRIPTION OF PREFERRED EMBODIMENT

The deep well pump of this invention is constructed so that it may be made with a long stroke, for example, fifty feet or more, and so that the pump is actuated only when the pump cylinder has been filled with liquid to a predetermined level; thus the pump is actuated to deliver liquid in accordance with the rate of the supply of the liquid and in units of volume each equal to the cylinder capacity.

Figure 1:
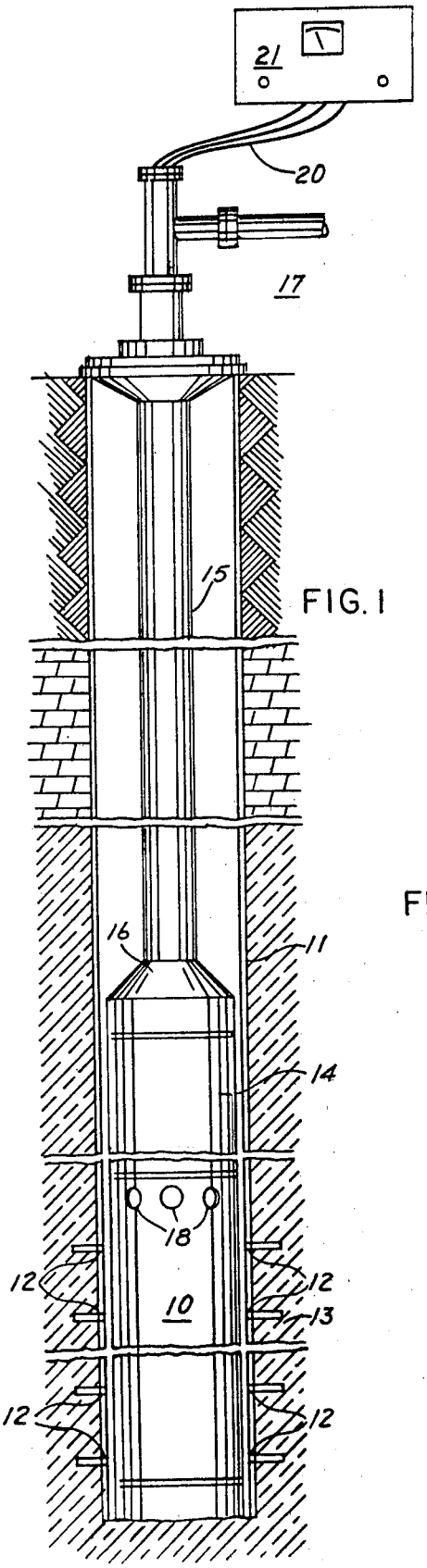
FIG. 1 is a diagrammatic sectional elevation view of a cased well in a reservoir formation having installed therein a deep well pump embodying the invention.

Referring now to the drawings, FIG. 1 illustrates a pump assembly 10 which is positioned within a well casing 11.

The casing is perforated to provide a multiplicity of inlet openings 12 adjacent a producing formation 13; the shot holes extend from the openings 12 into the formation for delivering formation fluids to the interior of the casing. The pump assembly includes a cylindrical housing 14 which is rigidly secured to and supported from a production tubing 15 by a reducing fitting 16. The tubing is suspended from a well head assembly 17. Fluids from the formation enter the casing and, on reaching a plurality of openings 18 in the housing 14, enter the housing where the liquid is accumulated and then pumped to the surface.

Power for driving the pump in the assembly is supplied through three-phase alternating current lines 20 from a conventional power source through a control unit 21. In this embodiment, the lines 20 pass through the production tubing to the pump assembly.

Both the pump assembly 10 and the tubing 15 have been shown with breaks, since both the assembly and the tubing are of much greater length than can be illustrated in proportion in the drawing.

Figure 2:
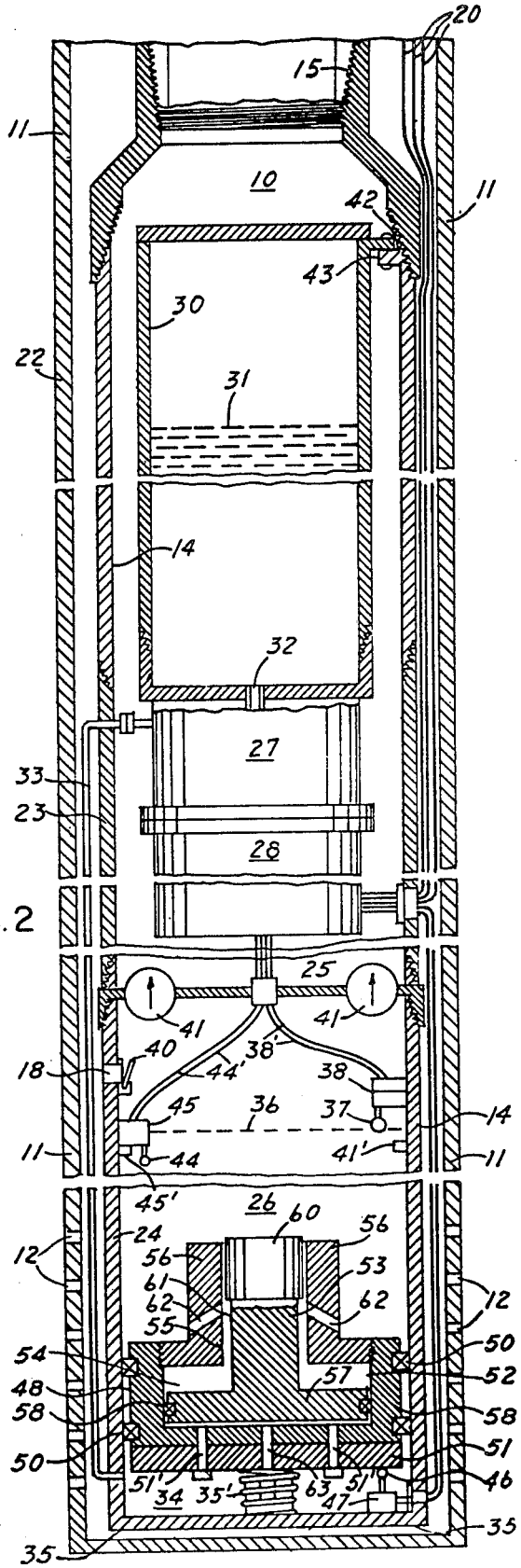
FIG. 2 is an enlarged somewhat diagrammatic sectional elevation view of the pump of FIG. 1.

In FIG. 2, the power lines 20 have been illustrated as lying outside the production tubing and pump assembly housing and pass into the housing through suitable insulating seals. The lines 20 preferably are tied to the production tubing.

The internal arrangement of the pump assembly is shown in FIG. 2; the housing 14 is cylindrical and has been illustrated as comprising upper, middle and lower sections 22, 23 and 24, respectively, which are threaded together by tapered threads in accordance with well known practice. The middle and lower sections are connected by a plate fitting 25 which constitutes a partition between these sections and divides the housing 14 into an upper chamber and a lower chamber. The lower chamber, which is entirely within the section 24, is the cylinder of the deep well pump, and a free piston assembly 26 is installed for reciprocation in the cylinder 24; this assembly being biased by gravity to its lowermost position in the housing. The upper chamber, which is defined by the two sections 22 and 23 has therein a hydraulic pump 27, an electric drive motor 28 therefor, and a reservoir or tank 30, which is filled with hydraulic fluid either completely or to a level such as indicated at 31. The reservoir above the liquid may be filled with a neutral gas such as nitrogen. The pump 27 is connected to receive liquid from the tank 30 through an inlet 32 and to deliver liquid through a supply line 33 to an expansible chamber 34 below the piston assembly 26, the bottom of the housing 14 being closed by an end plate 35. In its lowermost position, the pump assembly 26 rests on a spring seat 35, which determines the minimum volume of the expansible chamber 34.

During the operation of the pump assembly, as liquid flows through the openings 18 into the chamber above the piston assembly, it fills the chamber until it reaches a level indicated by a dotted line at 36 which is below the level of the openings 18. Gas also may enter the chamber and accumulates above the liquid. When the liquid reaches the level 36, a float 37 rises and actuates a switch 38, which is connected by leads 38' to the pump motor control and when actuated operates to start the motor 28 and drive the hydraulic pump 27. The motor has been illustrated with a break because the motor is of the deep well type and may be very long as compared with its diameter. The operation of the hydraulic pump produces a flow of high pressure liquid into the chamber 34 and the piston assembly is driven upwardly increasing the pressure in the pump cylinder, actuating check valves 40 to close the openings 18, and delivering fluids through check valves 41 in the partition 25, the fluids being delivered to the production tubing 15. The hydraulic pump and reservoir assembly is suspended within the housing 14 on a plurality of lugs or hangers, one of which is shown at 42 as bolted to an upwardly extending lug 43 at the top end of the section 22. The fluids flow freely upwardly through spaces between the hangers and lugs.

The gas which enters the pump cylinder collects in the upper end of the cylinder above the level of the liquid therein. When the electric motor is started by operation of the float switch 38 it moves the piston 26 against the weight of the accumulated liquid, the gas acts as a cushion and is easily compressed. Thus the starting load on the motor is low and the starting current which it draws is correspondingly low and the motor comes up to speed against a greatly reduced load before it is required to force the piston upwardly against the head of the oil in the production tubing. Thus the gate volume at the top of the pump cylinder serves to decrease the starting load on the motor which increases the life of the motor as well as reducing the power consumed on each operation thereof.

When the piston assembly reaches its top position, it engages an operating element 44 of a limit switch 45; the switch is connected by leads 45' to the pump control and the operation of the switch effects control of the hydraulic pump to reverse the flow of hydraulic fluid. The hydraulic fluid is thus withdrawn from the expansible chamber below the piston assembly 26 and returned to the reservoir 30. This reversal of flow may be accomplished by selecting a reversible pump which is reversed by reversing the electric motor or by providing reversing connections in the hydraulic circuit at the pump, either type of reversal being effected by operation of the limit switch 45 or another method of reversing the hydraulic fluid flow, the piston will strike a rigid stop 45' which may be an annular ring rigidly mounted on the inside wall of the section 24. This stopping of the piston will produce an abrupt rise in the pressure of the hydraulic liquid below the piston, and in the hydraulic pump which will actuate the high pressure control of the hydraulic pump 27 to relieve the excess pressure.

Upon reversal of the flow of hydraulic fluid, the piston assembly 26 returns toward its bottom position by gravity assisted by the removal of hydraulic liquid from below the piston assisted by the low pressure in the reservoir 30, and upon engaging the actuator 46 of a switch 47 stops the motor 28 until another full load of liquid accumulates in the pump chamber.

As shown in FIG. 2, the piston assembly 26 comprises a main piston 48 mounted for sliding movement in the cylinder 24. Leakage between the top and bottom sides of the piston 48 is prevented by suitable annular gaskets or rings 50 mounted in annular grooves about the piston. The piston assembly may be weighted by adding a plate or disc, as illustrated at 51 to facilitate its return to its lowermost position. The disc is illustrated as secured to the piston by bolts 51'.

During the operation of the pump assembly, the fluids entering the pump chamber through the openings 18 may carry some sand or other sediment into the chamber and this foreign matter will tend to settle in the bottom of the chamber on top of the piston assembly 26. In order to minimize the collection of sediment in the pump chamber, a device for agitating the sediment and creating turbulence is provided. For this purpose, the pump assembly 26 is constructed by forming the main piston as an upwardly opening cup thereby providing an internal cylindrical chamber 52 in which a piston 53 is slidably mounted. The chamber 52 includes a large diameter portion 54 and a reduced diameter portion 55; these cylinder portions are formed by a flanged cylindrical member 46 threaded in the larger diameter portion of the main piston. The piston 53 includes a portion 57 fitting the cup 54 and provided with sealing rings 58 to prevent leakage, and a reduced portion 60 extending upwardly through the reduced diameter portion 55 of the chamber 52. The upper portion 60 of the piston 53 acts as a guide and a reduced portion 61 provides communication between the larger diameter chamber or cup 54 and a plurality of downwardly inclined discharge passages 62.

When the operation of the hydraulic pump starts, high pressure liquid is admitted to the chamber 34 and immediately is applied to the lower side of the piston 57 through a port 63, which passes through the weighting disc 51 and the bottom of the main piston 48. This first application of the high pressure liquid forces the piston 53 suddenly upwardly and discharges liquid through the ports 62; the resulting downwardly directed jets of liquid create turbulence and agitate sediment lying on the top of the main piston and facilitate the discharge of the sediment with the liquid forced through the check valves 41, thereby preventing excessive accumulation of sediment and the trapping of sediment in the pump.

In the modification illustrated in FIG. 3 an arrangement is provided whereby the entire pump assembly may be installed in a well casing on a wire line. As shown in this figure, a pump assembly embodying the invention and indicated at 10 is threaded to a cylindrical base member 64 and is suspended therefrom and lowered through the casing into a well on a wire line 65. The wire line is secured to a springbiased plunger 66 which is slidably mounted at the center of a perforated wall or partition 67 or is otherwise secured to the inner wall of the base 64. A biasing spring 68 urges the plunger 66 downwardly and is compressed by the weight of the pump assembly when the wire line is lifted and under tension. The electric supply cable 20, which may be tied to the wire line, passes through one of the perforations in the plate 67 and hence enters the pump assembly 10.

An expansible packer 70 is mounted about the cylindrical base 64 and is arranged to be inflated when the pump assembly is in position in the well casing. The inflation of the packer is controlled by a timer 71, which is set to activate a valve 72 at a predetermined time after the pump has reached the desired position in the well. The activation of the valve 72 releases gas under pressure from a tank 73, the pressurized gas flowing through a pipe 74 to the inside of the packer. In FIG. 3, the plunger 66 has been illustrated in its position when the tension on the line 65 has been relieved. In this position the spring holds the plunger down and a valve 75 is in its normally closed position. The discharge of pressurized gas into the packing expands the packing against the casing and maintains the base 64 in position so that operation of the pump assembly 10 may produce a pressure differential between the casing below the packer and the casing above. The liquid may thus be pumped upwardly through the casing above the packer and the produced oil thus be delivered to the surface.

When it is desired to withdraw the pump assembly from the casing, the wire line 65 is tensioned, this compresses the spring 68 and moves an arm 76 upwardly into engagement with an actuating arm 77 of the valve 75. The pressure of the arm 76 against the arm 77 opens the valve 75 and releases the pressure from the packer, the gas flowing through a pipe 78, the valve 75 and a check valve 79. If the packer has not become bonded to the casing due to pressure and high temperatures, the pump assembly can be withdrawn easily from the casing. However, in the event of bonding of the packer to the casing, it may be difficult to withdraw the pump assembly on the wire line and in order to avoid undue stresses, it is desirable to provide an arrangement for effectively releasing the packing from the casing. For purposes of effective release, an arrangement has been provided which utilizes ultrasonic energy to vibrate the packer adjacent the casing. Vibrations at ultrasonic freqencies can break down the bond between the packer and the casing and when pressure is applied to raise the pump assembly on the wire line, the bond may be broken or weakened by the vibration and the packing released under the line tension.

The arrangement for applying ultrasonic energy to the packer as illustrated in FIGS. 3, 4 and 5 includes an ultrasonic frequency generator 80 having a supply lead 80' from the control at the surface; the generator is mounted within the base 64 and connected to apply ultrasonic wave energy to three electromechanical transducers 81 through leads 82. When the transducers 81 are energized they vibrate at ultrasonic frequency and the vibrations are transmitted directly to the base 64 against which the transducers are securely held.

In order to transmit the ultrasonic frequency vibrations to the material of the packer, the packer is constructed of inner and outer layers of material 83 and 84 and a plurality of flexible steel blades 85 are bonded to the material between the layers 83 and 84 and the steel blades are secured rigidly to the base 64 at the level of the transducers 81. The lower ends of the flexible members 85 terminate within the flexible material of the packing, the lower end of the packing being securely bonded to the base 64. The upper ends are also bonded to the base and a space between the base 64 and the packing is provided to receive and hold the pressurized gas. When the base 64 is vibrated by the transducers 81, the vibrations are transmitted directly into the steel members and hence into the material of the packing. The vibrations tend to break the bond between the packing and the casing and under the tension transmitted from the wire line 65, the vibrations facilitate the release of the packing from the casing so that the pump assembly may be withdrawn.

Under severe bonding conditions, it may be desirable to break the packer and for this purpose spurs or blades 86 are secured to the flexible steel members 85 adjacent the turn or corner of the packing at the top. The vibration of these blades when the packer is under tension serves to break the packer material and weaken it and thereby facilitate the removal of the packer from the casing wall. When the base 64 is raised on the wire line, the pressure on the packer will also tend to peel the packer away at its lower side adjacent the casing. Furthermore, the steel members 85 may be drawn up and away from the outer layer 84 of the packing material which will then be left at least in part bonded to the casing. Such remaining parts of the packer may easily be removed by suitable casing scrapers available for such purposes.

While the invention has been described in connection with a specific embodiment thereof, various modifications and other arrangements will occur to those skilled in the art, Therefore, it is not desired that this invention be limited to the specific constructions illustrated and described and it is intended by the appended claims to cover all modifications which fall within the spirit and scope of the invention.

I claim:

1. A deep well pump assembly including an upwardly extending cylindrical housing having therein a liquid pump and an electric motor for driving said pump, said pump having an intake for receiving liquid from a well and an outlet for discharging liquid under pressure through said housing, means for suspending said assembly on a wire line for insertion, lowering and positioning in a well casing, an inflatable packer mounted about the outside of said housing above said pump intake for providing a seal between said housing and the well casing whereby said pump may be utilized for pumping liquid upwardly through the well casing, a gas discharge outlet for said packer, a valve for controlling said gas discharge outlet of said packer, means for opening said valve upon tensioning of said wire line and for closing said valve upon the release of the tension on said wire line, a cylinder of gas under pressure mounted in said housing and connected for supplying gas from said cylinder to said packer and having a cylinder gas discharge control valve, and timing means for opening said cylinder gas discharge control valve after a preselected time interval for inflating said packer after said assembly has been positioned in the well and the tension on said wire line has been released to close said packer discharge outlet valve, said packer being deflated by the opening of said packer discharge outlet valve upon subsequent tensioning of the wire line.

2. A deep well pump assembly including an upwardly extending cylindrical housing having therein a liquid pump and an electric motor for driving said pump, said pump having an intake for receiving liquid from the well and an outlet for discharging liquid under pressure upwardly through said housing, means for suspending said assembly on a wire line for insertion, lowering and positioning in a well casing, means including an inflatable packer mounted about the outside of said housing above said pump intake for providing a seal between said housing and the well casing whereby said pump may be utilized to pump liquid upwardly through the well casing, means including a source of gas under pressure mounted within said cylinder for inflating said packer when in position within the well casing to effect said seal, means depending upon tensioning of the wire line for releasing the gas from said packer to deflate said packer, and means for vibrating said packer at ultrasonic frequency to facilitate the release of said packer from the well casing upon tensioning of the wire line to remove the assembly from its position in the casing.

3. A deep well pump assembly as set forth in claim 2 wherein said means for vibrating said packer includes an ultrasonic wave generator and at least one ultrasonic transducer connected to be energized thereby and mounted on the interior wall of said housing adjacent said packer for vibrating said housing and at least one flexible steel member rigidly secured to the exterior wall of said housing adjacent said transducer and extending with the material of said packer for transmitting ultrasonic vibrations to said packer adjacent the well casing.

4. A deep well pump assembly as set forth in claim 2 wherein said means for vibrating said packer includes an ultrasonic wave generator and at least one ultrasonic transducer mounted on the interior wall of said housing adjacent said packer for vibrating said housing and a plurality of flexible steel strips each rigidly secured at one end to said housing at substantial equal spacing about its circumference and extending axially of said packer in bonded engagement with the material thereof whereby the vibrations are transmitted to the material of said packer adjacent the well casing.

5. A deep well pump assembly as set forth in claim 2 wherein said flexible steel strips are secured to said housing adjacent the top of the packer, and each of said strips extends from the housing outwardly and then is bent down to extend along the packer, and a cutting element provided on each of said strips extending upwardly from the bent portion thereof into the material of the packer, said element when vibrated tending to cut through the packer material to release the upper end of the packer whereby the packer may be peeled away from the well casing as the bottom end of the packer is drawn upwardly by the tension on the wire line.

6. In a packer assembly for an oil well casing including a cylindrical housing and means adapted to afford the passage of the well production fluid therethrough, the improvement which comprises;

means for securing a production pump to said packer assembly for suspension therebelow to deliver well fluid to said housing, means for suspending said packer assembly on a wire line for insertion, lowering and positioning in a well casing, an inflatable packer mounted about the outside of said housing for providing a seal between said housing and the well casing, a gas discharge outlet for said packer, a valve for controlling said discharge outlet, means for opening said valve upon tensioning of said wire line and for closing said valve upon the release of the tension on said wire line, a cylinder of gas under pressure mounted in said housing and connected for supplying gas to said packer and having a gas discharge control valve, and timing means for opening said gas discharge control valve after a preselected time interval for inflating said packer after said packer assembly has been positioned in the well and the tension on said wire line has been released to close said packer discharge outlet valve, said packer being deflated by the opening of said packer discharge outlet valve upon subsequent tensioning of the wire line.

7. In a packer assembly for an oil well casing including a cylindrical housing and means adapted to afford the passage of the well production fluid therethrough, the improvement which comprises;

means for securing a production pump to said packer assembly for suspension therebelow to deliver well fluid to said housing, means for suspending said packer assembly on a wire line for insertion, lowering and positioning in a well casing, means including an inflatable packer mounted about the outside of said housing for providing a seal between said housing and the well casing, means including a source of gas under pressure mounted within said housing for inflating said packer when in position within the well casing to effect said seal, means depending upon tensioning of the wire line for releasing the gas from said packer to deflate said packer, and means for vibrating said packer at ultrasonic frequency to facilitate the release of said packer from the well casing upon tensioning of the wire line to remove the assembly from its position in the casing.

8. A deep well pump assembly including a packer assembly for an oil well casing including a cylindrical housing and means adapted to afford the passage of fluid therethrough, means for suspending said assembly on a wire line for insertion, lowering and positioning in a well casing, means including an inflatable packer mounted about the outside of said housing for providing a seal between said housing and the well casing, means including a source of gas under pressure mounted within said housing for inflating said packer when in position within the well casing to effect said seal, means depending upon tensioning of the wire line for releasing the gas from said packer to deflate said packer, means for vibrating said packer at ultrasonic frequency to facilitate the release of said packer from the well casing upon tensioning of the wire line to remove the assembly from its position in the casing, said means for vibrating said packer including an ultrasonic wave generator and at least one ultrasonic transducer connected to be energized thereby and mounted on the interior wall of said housing adjacent said packer for vibrating said housing and at least one flexible steel member rigidly secured to the exterior wall of said housing adjacent said transducer and extending with the material of said packer for transmitting ultrasonic vibrations to said packer adjacent the well casing.

9. A deep well pump assembly including a packer assembly for an oil well casing including a cylindrical housing and means adapted to afford the passage of fluid therethrough, means for suspending said assembly on a wire line for insertion, lowering and positioning in a well casing, means including an inflatable packer mounted about the outside of said housing for providing a seal between said housing and the well casing, means including a source of gas under pressure mounted within said housing for inflating said packer when in position within the well casing to effect said seal, means depending upon tensioning of the wire line for releasing the gas from said packer to deflate said packer, means for vibrating said packer at ultrasonic frequency to facilitate the release of said packer from the well casing upon tensioning of the wire line to remove the assembly from its position in the casing, said means for vibrating said packer including an ultrasonic wave generator and at least one ultrasonic transducer mounted on the interior wall of said housing adjacent said packer for vibrating said housing and a plurality of flexible steel strips each rigidly secured at one end to said housing at substantial equal spacing about its circumference and extending axially of said packer in bonded engagement with the material thereof whereby the vibrations are transmitted to the material of said packer adjacent the well casing.

10. A deep well pump assembly including a packer assembly for an oil well casing including a cylindrical housing and means adapted to afford the passage of fluid therethrough, means for suspending said assembly on a wire line for insertion, lowering and positioning in a well casing, means including an inflatable packer mounted about the outside of said housing for providing a seal between said housing and the well casing, means including a source of gas under pressure mounted within said housing for inflating said packer when in position within the well casing to effect said seal, means depending upon tensioning of the wire line for releasing the gas from said packer to deflate said packer, means for vibrating said packer at ultrasonic frequency to facilitate the release of said packer from the well casing upon tensioning of the wire line to remove the assembly from its position in the casing, said flexible steel strips being secured to said housing adjacent the top of the packer, and each of said strips extending from the housing outwardly and then being bent down to extend along the packer, and a cutting element provided on each of said strips extending upwardly from the bent portion thereof into the material of the packer, said element when vibrated tending to cut through the packer material to release the upper end of the packer whereby the packer may be peeled away from the well casing as the bottom end of the packer is drawn upwardly by the tension on the wire line.

* * * * *